United States Patent [19]

Beitner

[11] 4,143,711

[45] Mar. 13, 1979

[54] PORTABLE REFRIGERATOR UNIT

[75] Inventor: Shlomo Beitner, Tel-Aviv, Israel

[73] Assignee: Bipol Ltd., Israel

[21] Appl. No.: 892,074

[22] Filed: Mar. 31, 1978

Related U.S. Application Data

[62] Division of Ser. No. 708,569, Jul. 26, 1976, Pat. No. 4,107,934.

[51] Int. Cl.[2] ..... F28F 7/00; F25B 21/02

[52] U.S. Cl. ..... 165/185; 62/3

[58] Field of Search ..... 165/185; 62/3, 457

[56] References Cited

U.S. PATENT DOCUMENTS

| | | | |
|---|---|---|---|
| 3,095,037 | 6/1963 | Bohm | 165/185 |
| 3,194,024 | 7/1965 | Bassett, Jr. | 62/3 |
| 3,310,953 | 3/1967 | Rait | 62/3 |
| 3,412,566 | 11/1968 | Townsend et al. | 62/3 |
| 4,007,600 | 2/1977 | Simms | 62/3 |

*Primary Examiner*—Lloyd L. King

*Attorney, Agent, or Firm*—Gordon W. Hueschen

[57] ABSTRACT

A portable refrigerator unit is cooled by a thermoelectric element of the Peltier type, having hot and cold faces adapted to be energized by an external DC source, which can be disconnected from the unit to make the unit entirely portable. The thermoelectric unit has a cold face in contact with an internal thermal sink, which in turn is in contact with a heat conducting lining, and its hot face in contact with an external thermal sink, having heat dissipating means associated therewith. The internal thermal sink has a large portion imbedded in an insulated wall of the unit, and a relatively small portion having a face free of the insulating material, which free face is in heat-transfer contact with the cold face of the thermoelectric unit. The external thermal sink with its heat dissipating means is spaced from said unit so that its surfaces are exposed to the ambient atmosphere. The external thermal sink and its associated heat dissipating means is made of a single sheet having a flat central portion, laterally extending loops with the free ends thereof underlying the flat central portion with the three portions in heat-transfer contact with each other to form the thermal sink.

3 Claims, 4 Drawing Figures

FIG. 1
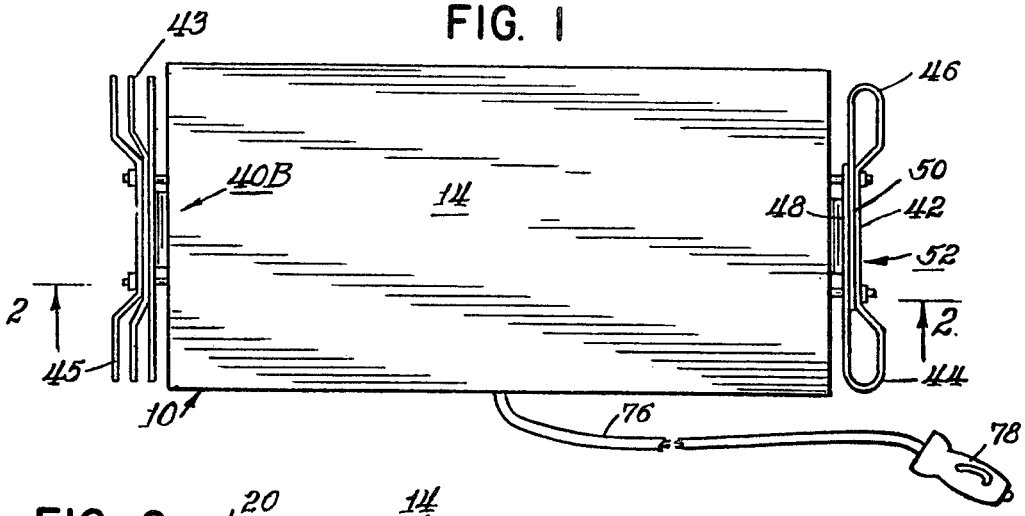
FIG. 2
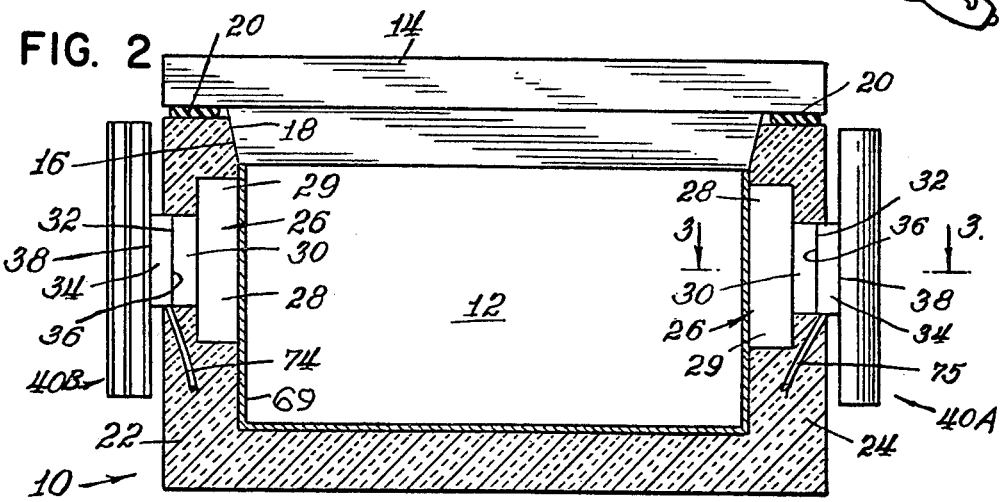
FIG. 4
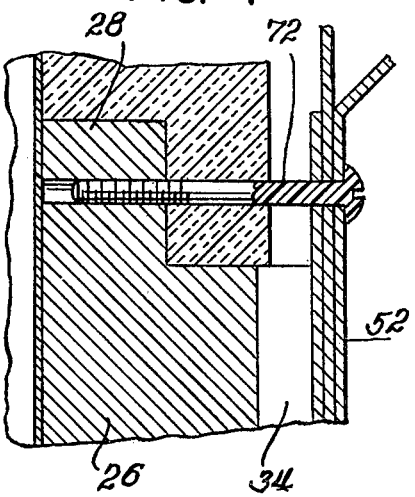
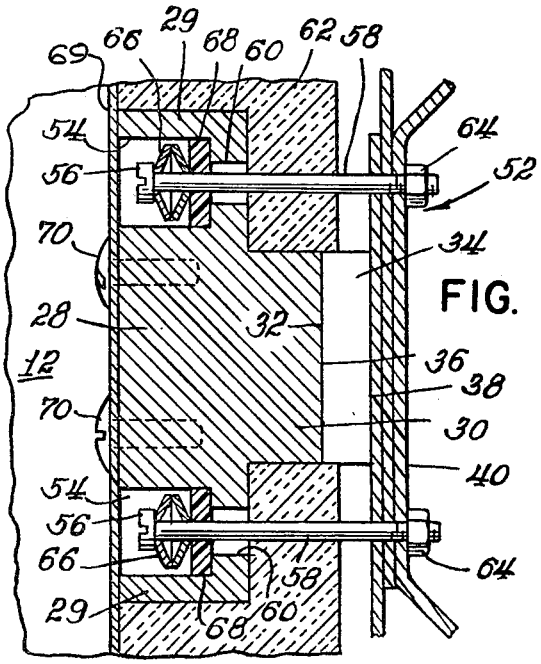
FIG. 3

PORTABLE REFRIGERATOR UNIT

This is a division of application Ser. No. 708,569, filed July 26, 1976, now U.S. Pat. No. 4,107,934.

BACKGROUND OF THE INVENTION

1. Field of Invention

The invention relates to a portable refrigerator unit cooled by a thermoelectric element of the Peltier type having hot and cold faces adapted to be energized by an external DC source, and adapted to be disconnected from said unit to make the unit entirely portable, and to a method for transporting food to picnic areas.

2. Prior Art

It is well known in the art that a heating and cooling effect can be produced by impressing a DC voltage across a thermoelectric element of the Peltier type, and this effect has been utilized for cooling the interior of a portable refrigerator or other surface. Such applications of thermoelectric elements of the Peltier type, for example, are found in, among others, U.S. Pat. Nos. 3,314,242, 3,230,723, 3,220,198, 3,194,023, 3,178,896, 3,168,816, 3,018,631, and 3,048,020. Such devices, however, have complicated structures for conducting heat to the cold face of the thermoelectric unit and thereafter conducting heat from the hot face thereof to the ambient atmosphere. Moreover, in all these units, the power pack is an integral part of the unit, so that the unit is not entirely portable. Also, none of these units have an internal thermal sink firmly imbedded in an insulated wall of the unit with an external thermal sink secured thereto and maintaining the thermoelectric element in compression between the two thermal sinks. None of the prior art devices shows a simple and effective portable refrigeration unit which can, for example, be energized by an automobile or boat battery while traveling, and disconnected therefrom in order to take the unit to a picnic area.

OBJECTS OF THE INVENTION

It is an object of the invention to provide a new and effective portable refrigerator unit. It is a further object of the invention to provide such a unit which is simple to construct and easy to operate. It is a further object of the invention to provide new and effective means for dissipating heat from such a unit. It is a further object of the invention to provide new and effective means for effecting transfer of heat from the interior of the unit to the ambient atmosphere. Further objects of the invention are to avoid the disadvantages of the prior art and to obtain such advantages as will appear as the description proceeds.

SUMMARY OF THE INVENTION

The invention relates to a portable refrigerator unit cooled by a thermoelectric unit of the Peltier type, having hot and cold faces adapted to be energized by an external energy source, and adapted to be disconnected from said unit to make the unit entirely portable.

The novel unit, according to the invention, comprises an insulated container having a heat conducting lining therein, and means, including said thermoelectric element, for conducting heat from said heat conducting lining to the ambient atmosphere. The heat conducting means also includes an internal thermal sink imbedded in an insulated wall of the container, having a relatively large portion confined between the lining and the insulating material of the insulated wall, and a relatively small portion having a face free of said insulating material. The thermoelectric element has its cold face in heat-transfer contact with the free face of said internal thermal sink, and at least the cold portion thereof imbedded in said insulated wall. The thermoelectric element also has its hot face in heat-transfer contact with a heat dissipating means having an external thermal sink, which is spaced from the unit and fastened to the internal thermal sink by means which places the thermoelectric element in compression between the two thermal sinks.

Advantageously, the insulated wall of the unit in which the internal thermal sink is imbedded also has the thermoelectric element imbedded therein, up to a point between the cold face and the hot face thereof.

Advantageously, the means for fastening the two thermal sinks together comprises bolts recessed in the internal thermal sink, which are provided with washers of the Belville or spring type to compensate heat expansion. Also, the means for fastening the two thermal sinks together, desirably, has a low coefficient of heat-transfer, which may be accomplished by using bolts of material having a low coefficient of heat transfer, or by using bolts having a high coefficient of heat transfer and insulating them from the internal thermal sink.

Advantageously, the external thermal sink has radiating surfaces to promote heat-transfer to the ambient atmosphere. These heat dissipating means advantageously comprise a thermal sink of heat conducting material comprising a plurality of sheets having portions lapped in heat transfer contact with each other to form a flat central portion and laterally extending portions spaced from each other to admit the flow of ambient air between them. Advantageously, at least some of the laterally extending portions are formed into loops, each of which is preferably integral with two lapped portions.

The unit of the invention may be provided with a pigtail adapted to be plugged into the cigarette lighter of an automobile or boat, or otherwise connected with the battery thereof.

Advantageously, the unit has a jack means whereby the pigtail may be disconnected from the unit. Also, the adapter plug or the cord may have resistance built into them where it is desired to drop the DC voltage from the twelve volts now standard in automobiles.

It will thus be seen that the invention provides an entirely portable unit which is light in weight, not being encumbered by any transformers or fans, which can be plugged into the cigarette lighter socket of any boat or automobile, whereby the contents of the unit are kept cold while traveling, and yet which can be disconnected from the power source and easily transported to the site where the contents of the unit are to be utilized.

This invention also relates to a method for transporting food to a picnic site, utilizing the portable refrigerator of the invention. Thus, in accordance with the novel method of the invention, that food is placed in a portable refrigerator unit, cooled therein in transit by means of a thermoelectric unit of the Peltier type connected to a battery comprising part of the transit means, until the picnic site is reached, the battery then disconnected from said unit, and the unit then hand-transported to the picnic site.

BRIEF DESCRIPTION OF THE DRAWINGS

In the drawings,

FIG. 1 is a plan view,

FIG. 2 is a cross-section taken along line 2—2 of FIG. 1,

FIG. 3 is a fragmentary cross-sectional view taken along line 3—3 of FIG. 2, and FIG. 4 is a fragmentary cross-sectional view of a modification of FIG. 3.

DETAILED DESCRIPTION OF THE INVENTION

The portable refrigerator unit of the invention comprises an insulated container 10 having a container portion 12 and a cover portion 14. The container portion 12 has a beveled mouth 16, and the cover 14 has a complementarily beveled portion 18. A gasket 20 is provided further to enhance the sealing effect of the cover 14.

The end walls 22 and 24 of the insulated container have imbedded in the insulation thereof an internal thermal sink 26, which has a relatively large portion 28 imbedded in the insulation of the walls 22–24, and a relatively small portion 30 having a face 32 which is free of the insulation. A thermoelectric element of the Peltier type 34 has its cold face 36 in heat-transfer contact with the free face 32 of the thermal sink 26, and its hot face 38 in heat-transfer contact with an external heat dissipator 40. The relatively small portion 30 has essentially the same shape and size as the cold face 36 of the thermoelectric element and extends inwardly therefrom a substantial distance, say from one-half to three or four times the thickness of the thermoelectric element 34. Thus, the thickness of the insulating material adjacent the thermoelectric element will be one or more times the thickness of the thermoelectric element. Optimally, the portion 30 has the same size as the cold face 36, but desirably, may be slightly larger to insure against misalignment during assembly.

The external heat dissipator shown at 40A is made of an integral sheet having a flat central portion 42, having laterally extending loops 44 and 46, with their free end portions 48 and 50, respectively, bent back under the central portion 42 and in heat-transfer contact to provide a thermal sink 52 with lateral extending heat dissipating loops 44 and 46. That shown at 40B is made up of a plurality of sheets of heat conducting material having portions 41 lapped in heat-transfer contact with each other and laterally extending portions 43 and 45 spaced from each other to permit the free flow of ambient air between them.

The large portion 28 has a larger expanse than the portion 30 and has outwardly projecting flanges 29 which may extend all around the portion 30, or only from opposite sides thereof. The flanges 29 are provided with wells or recesses 54 adjacent the outer edges thereof, and beyond the relatively small portion 30. These recesses 54 are adapted to receive the heads 56 of bolts 58 which pass through an aperture 60 in the bottom of the recess 54 through the insulation material 62, which extends beneath the relatively large portion 28 and through and/or into the external thermal sink 52, where they are either threaded therein or fastened thereto with nuts 64. Belville or spring washers 66 are provided to compensate heat expansion and, if desired, a heat insulating washer 68 is provided between the head 56 and the Belville or spring washer 66 to minimize heat transfer along bolt 58, in which case the aperture or hole 62 is made larger than the bolt, and the washer 68 is constructed to center the bolt in the hole or aperture 60.

The bolts 58 may be made of material having relatively low heat-transfer coefficient, for example, stainless steel and the mid-portion may have a reduced thickness as compared with the head portion and the threaded portion, further to reduce heat transfer.

By tightening the bolt 58, the thermoelectric element 34 is placed in compression between the opposed faces of the internal thermal sink and the external thermal sink, thereby being maintained in close heat-transfer contact. If desired, the heat-transfer contact can be enhanced by the use of heat conductive greases, for example, a silicone grease.

The heat conducting lining 69 is similarly fastened in heat-transfer contact with the internal thermal sink 26 by means of bolts 70. The heat-transfer contact can also be enhanced here by use of heat conducting grease.

In the modification shown in FIG. 4, the external thermal sink 52 is fastened to the relatively large portion 28 of the internal thermal sink 26 by means of bolts 72 composed of material having a relatively low heat-transfer coefficient; for example, nylon or like strong machinable plastic.

The thermoelectric unit 34 is connected by means of electrical cords 74 and 75, which are imbedded in the insulating material of the main container and are connected to the pigtail 76 having the adapter plug 78 at the end thereof. The adapter plug is of the conventional type adapted to fit into the cigarette lighter socket in an automobile or boat. The adapter 78 and/or the pigtail 76 can have built-in resistors to reduce the voltage as may be desired. The pigtail 76, if desired, can be detachable from the unit 10 by suitable jack means not shown. If such jack means is used, it should be polarized to make sure that the right polarity is impressed on the thermoelectric element.

In using the portable refrigerator unit of the invention, the container is packed with foods which are either perishable or which are best kept cold, and the unit plugged into the cigarette outlet of the vehicle used for transit. All during transit, heat will be pumped out of the refrigerator unit by the Peltier effect, and the food will be kept cold. When the site of the picnic is reached, the unit is unplugged and hand-carried to wherever the unit is to be used. During this time, no power input is impressed on the thermoelectric unit, and the food is maintained cold solely by virtue of the insulating properties of the container. Since no power packs or cooling fans are associated with the unit of the invention, the weight thereof is scarcely more than that of conventional coolers used for like purposes and, in fact, since in the modification shown there is no outside metal skin, the unit will not weigh much more, if any more, than comparable units not utilizing the Peltier cooling effect.

The thermoelectric elements used in the units are well known in the art. Generally, they are made up of a plurality of electrically connected P-N type crystals and faced with electrical insulating material which may be an epoxy resin, or, more desirably, a heat conducting ceramic material.

It is to be understood that the invention is not to be limited to the exact details of operation or materials of construction shown and described, as obvious variations and equivalents will be apparent to one skilled in the art.

I claim:

1. A heat dissipator which comprises a thermal sink of heat-conducting material comprising a plurality of sheets having portions lapped in heat transfer contact with each other to form a flat central portion and laterally extending portions spaced from each other to permit the free flow of ambient air between them, in which at least some of the laterally extending portions are formed into loops.

2. The heat dissipator unit of claim 1, in which each loop is integral with two lapped portions.

3. The heat dissipator unit of claim 2, in which one of the lapped portions is integral with two loops.

* * * * *